US008240103B2

(12) United States Patent
Riepe

(10) Patent No.: US 8,240,103 B2
(45) Date of Patent: Aug. 14, 2012

(54) WALL CONSTRUCTION METHOD USING INJECTED URETHANE FOAM BETWEEN THE WALL FRAME AND AUTOCLAVED AERATED CONCRETE (AAC) BLOCKS

(76) Inventor: Frank Warner Riepe, Sudbury, MA (US)

( * ) Notice: Subject to any disclaimer, the term of this patent is extended or adjusted under 35 U.S.C. 154(b) by 262 days.

(21) Appl. No.: 12/403,052

(22) Filed: Mar. 12, 2009

(65) Prior Publication Data

US 2010/0229489 A1 Sep. 16, 2010

(51) Int. Cl.
*E04C 3/30* (2006.01)

(52) U.S. Cl. ..... 52/565; 52/309.4; 52/426

(58) Field of Classification Search ..... 52/309.4, 52/565, 361, 426
See application file for complete search history.

(56) References Cited

U.S. PATENT DOCUMENTS 3,943,676 A 3/1976 Ickes
6,098,364 A * 8/2000 Liu ..... 52/506.08
6,467,229 B2 * 10/2002 Azar ..... 52/589.1
6,510,667 B1 1/2003 Cottier et al.
6,532,710 B2 3/2003 Terry
7,204,060 B2 4/2007 Hunt
7,814,716 B2 * 10/2010 Moffatt ..... 52/204.55
2001/0045070 A1 11/2001 Hunt
2007/0062151 A1 3/2007 Smith
2007/0151190 A1 * 7/2007 Huff et al. ..... 52/592.5
2008/0010920 A1 1/2008 Andersen
2008/0016803 A1 1/2008 Bathon et al.

OTHER PUBLICATIONS

Dow Building Solutions Dec. 2008 archived webpage—Spray Polyurethane Foam.*
Spray Foam Alaska (copyright 2007 archived webpage).*

* cited by examiner

*Primary Examiner* — Jeanette E Chapman
*Assistant Examiner* — Daniel Kenny
(74) *Attorney, Agent, or Firm* — Daniel N. Smith

(57) ABSTRACT

A novel wall system for residential and light commercial construction that incorporates autoclaved aerated concrete (AAC). This wall system comprises AAC blocks married to a building frame with a system of clips. The AAC blocks are joined one to the next with thin-bed mortar. The cavity between the frame and the AAC blocks is injected with structural insulating foam. The exterior of the autoclaved aerated concrete walls is finished with waterproof decorative stucco.

12 Claims, 7 Drawing Sheets

WALL CONSTRUCTION METHOD USING INJECTED URETHANE FOAM BETWEEN THE WALL FRAME AND AUTOCLAVED AERATED CONCRETE (AAC) BLOCKS

FIELD OF THE INVENTION

This invention relates to a novel building system comprising an exterior wall of autoclaved aerated concrete (AAC) attached to the building frame through building clips and sealed with urethane foam insulation.

BACKGROUND OF INVENTION

There are many conventional construction systems used for residential and light commercial building projects which employ sheathing over wood and/or light-gage steel frames combined with insulation and exterior cladding components that are faulty in allowing leakage, thermal bridging, air infiltration, decay, and attack by insects, mold and mildew as well as being vulnerable to fire.

For example, U.S. Pat. No. 6,510,667, Cottier et al. disclose a process for constructing a wall that includes the steps of erecting a rigid frame and attaching fiber reinforced cementitious sheets to the front and rear faces of the frame to form a void there between. This void is then filled with light weight aggregate concrete slurry and allowed to cure. The lightweight aggregate slurry to fill the void formed between the sheets may be of conventional composition and can incorporate pulverized scrap polystyrene foam material ("grist") or expanded polystyrene beads. The cementitious sheets may comprise an autoclaved cured reaction product of metakaolin, Portland cement, crystalline siliceous material and water. U.S. Pat. No. 6,532,710, Terry discloses a solid monolithic concrete insulated wall system comprising 100% concrete construction on interior walls and exterior walls of buildings. Building materials consist of conventional concrete which is poured inside a cavity between two stay in place forming walls completely around the perimeter of the building. A highly cellular, lightweight material from quartzite, lime and water, known as Autoclaved Aerated Concrete (AAC) is used as a "stay in place" forming system of the exterior walls and interior walls. Two AAC walls run the entire perimeter of the respective building. The two walls are designed to form a cavity in which the concrete is poured. Anchor bolts, which are bolted deep into each side of the walls, hang into the cavity. For insulation purposes two sheets of foil backed insulation are attached to the inside of the outside wall by the anchor bolts. U.S. Pat. No. 7,204,060, Hunt discloses a system for manufacturing structures by the use of autoclaved aerated concrete. A first step is construction of the wall system, which comprises a first course of elongated AAC base blocks for placement on a pre-built foundation. U.S. Pat. No. 3,943,676, Ickes discloses a modular building wall unit comprising a hard foam layer and a concrete layer intimately bonded to each other along an interface between the layers. A reinforcing wire mesh matt is embedded in the hard foam layer and reaches with anchoring elements into the concrete layer which may also have embedded therein a further wire mesh matt. U.S. Published Patent Application No. 2008/0016803, Bathon et al. disclose a wood concrete composite system that comprises a wood construction component, an intermediate layer and a concrete construction unit. A single intermediate layer consists, for example, of a plastic foil, an impregnated paper, a bitumen pasteboard, a plastic insulating layer, a mineral insulating layer, an organic insulation material, a regenerating insulating material and up-poured and/or applied materials, which tie and/or harden at a later time, e.g. tar, adhesive, plastic mixtures. The range of types of concrete suitable for the concrete construction unit includes aerated concrete. U.S. Published Patent Application No. 2007/0062151, Smith discloses a composite building panel which includes a frame and a concrete slab made of aerated concrete. Fastened to the frame members is a reinforcing layer. The frame is oriented towards the interior side of the structure and the concrete slab is oriented towards the exterior side of the structure. The exposed frame provides cavities for the installation of plumbing, electrical wiring and insulation. U.S. Published Patent Application No. 2008/0010920, Andersen discloses a method of building construction wherein blocks and panels made from autoclaved aerated concrete are used as structural elements, including insulated panels having a rigid polyurethane/polyiscocyanurate foam core, are attached to structural elements via metal anchoring clips. U.S. Published Patent Application No. 2005/0284100, Ashuah et al. disclose a wall section having a sandwich like structure, which includes an external vertical panel and an internal vertical panel spaced apart in a parallel relationship, further including a vertical insulating layer. The external panel may be constructed of building blocks made of concrete or AAC. The internal panel may be constructed of wood panel. Between the panels there is a space, "core" which includes a vertical layer of concrete. The outer surface of the external panel is covered with a coating layer constructed of materials selected from among a group comprising of stone, marble, mortar, wood, aluminum, glass, porcelain and ceramics. U.S. Published Patent Application No. 2001/0045070, Hunt, Christopher M. discloses autoclaved aerated concrete panels, and method of making and using such panels, specifically for the construction of residential homes.

In addition to the conventional construction systems which employ sheathing over wood and/or light-gage steel frames combined with insulation and exterior cladding components, other conventional construction techniques use exterior walls composed of autoclaved aerated concrete (AAC) concrete.

Autoclaved Aerated Concrete (AAC) is a structural product composed of a mixture of cement, lime, water, and sand and aluminum powder. To manufacture AAC, cement is mixed with lime, silica sand, water, and aluminum powder and poured into a mold. The reaction between aluminum and cement causes microscopic hydrogen bubbles to form, expanding the cement to about five times its original volume. After evaporation of the hydrogen, the aerated concrete is cut to size and steam-cured in an autoclave.

It is an object of the present invention to overcome or substantially ameliorate at least some of the disadvantages of conventional construction techniques through the development of a building system that incorporates an exterior wall of autoclaved aerated concrete (AAC) attached to standard building framing through building clips and sealed with injected urethane foam insulation.

The building system of the present invention provides many benefits to the construction of residential and commercial buildings, including, but not limited to: providing high thermal resistance; preventing thermal bridging; providing increasing protection against water damage, vapor damage, fire, decay, mold or mildew damage, frost damage and insect damage; being impact resistance; reducing the need for painting or maintenance; the absence of any toxic compounds; providing a greater acoustical barrier and providing stronger shear strength. In addition, the building system is lightweight for transport and construction and compatible with existing plumbing, wiring, roofing, exterior stuccos and interior finishes commonly used.

SUMMARY OF THE INVENTION

The subject invention comprises a composite construction system coupling a frame and AAC concrete blocks, the system comprising: a load bearing frame and at least a single intermediate layer of urethane foam, an AAC concrete construction unit wherein one side of the AAC concrete construction unit faces towards the load bearing frame, and further wherein the at least single intermediate layer of urethane foam is interposed between the load bearing frame and the AAC concrete construction unit so as to couple the load bearing frame and the AAC concrete; and a plurality of connection devices between the load bearing frame and the AAC concrete construction unit.

In one embodiment of the subject invention, the load bearing frame is made out of at least one of a group of materials consisting of solid wood, timber materials, engineered wood products, wood composite materials, steel and aluminum.

In another embodiment of the subject invention, the plurality of connection devices comprises clips.

In a further embodiment of the subject invention, each of the plurality of connection devices comprises at least a first attachment surface for attachment to the load bearing frame and at least a second attachment surface for attachment to the AAC concrete construction unit.

In another embodiment of the subject invention, the AAC concrete construction unit comprises a plurality of AAC blocks.

In one embodiment of the subject invention, each of the plurality of AAC blocks comprises at least one groove for attaching to the plurality of connection devices.

In a further embodiment of the subject invention, an exterior finish applied to the exterior of the AAC concrete construction.

In another embodiment of the subject invention, an interior finish applied to the interior face of the load-bearing frame.

In one embodiment of the subject invention, the load bearing frame and the AAC concrete construction are erected on a concrete foundation.

In another embodiment of the subject invention, the distance between the load bearing frame and the AAC concrete construction comprises 1" to 4".

In a further embodiment of the subject invention, the clips comprise a material selected from a group consisting of metal and plastic.

In one embodiment of the subject invention, the connection devices comprise at least one traversing hole for accepting a screw, nail or bolt.

In another embodiment of the subject invention, the single intermediate layer of urethane foam comprises a width of 2" to 8".

The subject invention also comprises a method of constructing a wall, the method comprising the steps of: a) erecting a load-bearing frame defining front and rear faces of the wall on a foundation; b) placing a first plurality of connection devices on top of the foundation exterior to the load bearing frame, wherein each of the first plurality of connection devices comprises an interlock stub, further wherein each of the first plurality of connection devices is placed such that the interlock stub extends in an upward direction from the foundation distal from the load bearing frame; c) placing a first plurality of AAC blocks on top of the placed first plurality of connection devices exterior to the load-bearing frame by inserting the interlock stubs of the placed first plurality of connection devices into a bottom groove on each AAC block, such that a vertical internal cavity is created between the load-bearing frame and the first plurality of AAC blocks, further wherein each AAC block further comprises a top groove; d) placing a second plurality of connection devices on top of the first plurality of AAC blocks, wherein each of the second plurality of connection devices comprises a downward interlock stub and an upward interlock stub, further wherein each of the second plurality of connection devices is placed such that the downward interlock stub is inserted into the top groove of the first plurality of AAC blocks, and the upward interlock stub is distal from the load-bearing frame; e) placing a second plurality of AAC blocks on top of the placed second plurality of connection devices such that the upward interlock stubs of the placed second plurality of connection devices are inserted into the bottom grooves of the second plurality of AAC blocks such that the first and second plurality of AAC blocks form the bottom exterior of the wall; f) placing a third plurality of connection devices on the second plurality of AAC blocks using the method of step e; g) repeating steps e and f using additional pluralities of AAC blocks and connection devices to form the exterior of the wall and expand the vertical internal cavity separating the AAC blocks and the load-bearing frame; h) applying an exterior finish to the exterior of the AAC blocks; i) injecting a urethane foam into the vertical internal cavity and allowing said urethane foam to set and cure; and j) applying an interior finish to the interior of the load-bearing frame.

The subject invention further comprises a method of constructing a wall, the method comprising the steps of: a) erecting a load-bearing frame defining front and rear faces of the wall with bracing on a foundation; b) placing a plurality of shelf angles on top of the foundation exterior to the load bearing frame, wherein each of the shelf angles comprises a vertical leg and an interlock stub, further wherein each shelf angle is placed such that the vertical leg extends in an upward direction from the foundation and contacts the load bearing frame, and the interlock stub extends in an upward direction from the foundation distal from the load bearing frame; c) placing a first plurality of autoclaved aerated concrete (AAC) blocks on top of the placed plurality of shelf angles exterior to the load-bearing frame by inserting the interlock stubs of the placed plurality of shelf angles into a bottom groove on each AAC block, such that a vertical internal cavity is created between the load-bearing frame and the first plurality of AAC blocks, further wherein each AAC block further comprises a top groove; d) placing a first plurality of clip fasteners on top of the first plurality of AAC blocks, wherein each of the clip fasteners comprises an anchorage leg, an upward interlock stub and a downward interlock stub, further wherein each clip fastener is placed such that the downward interlock stub is inserted into the top groove of the first plurality of AAC blocks, the anchorage leg extends in an upward direction and contacts the load-bearing frame, and the upward interlock stub is distal from the load-bearing frame; e) placing a second plurality of AAC blocks on top of the placed plurality of clip fasteners such that the upward interlock stubs of the placed plurality of clip fasteners are inserted into the bottom grooves of the second plurality of AAC blocks such that the first and second plurality of AAC blocks form the bottom exterior of the wall; f) placing a second plurality of clip fasteners on the second plurality of AAC blocks using the method of step d; g) repeating steps e and f using additional pluralities of AAC blocks and clip fasteners to form the exterior of the wall and expand the vertical internal cavity separating the AAC blocks and the load-bearing frame; h) applying an exterior finish to the exterior of the AAC blocks; i) injecting a urethane foam into the vertical internal cavity and allowing said urethane foam to set and cure; and j) applying an interior finish to the interior of the load-bearing frame.

In one embodiment of the subject invention, the exterior finish comprises a cementitious stucco finish.

In one embodiment of the subject invention, the interior finish comprises plaster.

In another embodiment of the subject invention, the urethane foam comprises polyurethane foam.

In a further embodiment of the subject invention, the polyurethane foam comprises a water-vapor permeability of less than one perm and thermal performance of R-5 per inch.

In one embodiment of the subject invention, the load-bearing frame comprises a material selected from a group consisting of wood and metal.

In a further embodiment of the subject invention, the foundation comprises a concrete foundation.

In another embodiment of the subject invention, the method further comprises the step of anchoring the first plurality of connection devices to the foundation.

In one embodiment of the subject invention, the method further comprises the step of adding an adhesive to the top and bottom grooves of the AAC blocks before placing them on the wall.

In a further embodiment of the subject invention, the pluralities of connection devices or clips comprise a material selected from a group consisting of metal and plastic.

In another embodiment of the subject invention, the top and bottom grooves of the AAC blocks comprise a space ½" deep and ¼" wide.

In one embodiment of the subject invention, the vertical internal cavity separating the wall of AAC blocks and the load-bearing frame comprises a width of 1" to 6".

In a further embodiment of the subject invention, the method further comprises the step of attaching the vertical legs of the plurality of shelf angles to the load bearing frame.

In another embodiment of the subject invention, the method further comprises the step of attaching the anchorage legs of the plurality of clip fasteners to the load-bearing frame.

In another embodiment of the subject invention, the method further comprises the step of placing leveling grout into any gaps underneath the placed plurality of shelf angles on the foundation.

In one embodiment of the subject invention, the shelf angles comprise pultruded fiberglass.

In a further embodiment of the subject invention, the shelf angles comprise a traversing hole for accepting a screw, nail or bolt.

In another embodiment of the subject invention, the clip fasteners comprise a traversing hole for accepting a screw, nail or bolt.

In another embodiment of the subject invention, the vertical leg of the shelf angles comprises a wide base that narrows as it extends upwards to form an inclined surface facing away from the load bearing frame.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto. These together with other objects of the invention, along with the various features of novelty, which characterize the invention, are pointed out with particularity in the claims annexed to and forming a part of this disclosure.

For a better understanding of the invention, its operating advantages and the specific objects attained by its uses, reference should be made to the accompanying drawings and descriptive matter in which there are illustrated preferred embodiments of the invention. Other features and advantages of the present invention will become apparent from the following description of the preferred embodiment(s), taken in conjunction with the accompanying drawings, which illustrate, by way of example, the principles of the invention.

BRIEF DESCRIPTION OF THE DRAWINGS

Advantages of the present invention will be apparent from the following detailed description of exemplary embodiments thereof, which description should be considered in conjunction with the accompanying drawings, in which.

DETAILED DESCRIPTION OF THE PREFERRED EMBODIMENTS

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

The disclosed invention comprises a novel wall system for residential and light commercial construction that incorporates autoclaved aerated concrete (AAC) blocks. This wall system comprises an exterior wall composed of autoclaved aerated concrete blocks married to an interior wood or metal structural framing. The autoclaved aerated concrete would be married to the framing using novel construction clips. Furthermore, a cavity or space between the framing and the exterior walls of autoclaved aerated concrete blocks is injected with polyurethane foam insulation to glue the framing and the walls together and to provide further insulation. The exterior of the autoclaved aerated concrete walls further comprises an exterior cementitious stucco finish. The interior of the framing also comprises an interior finish.

Figure 1:
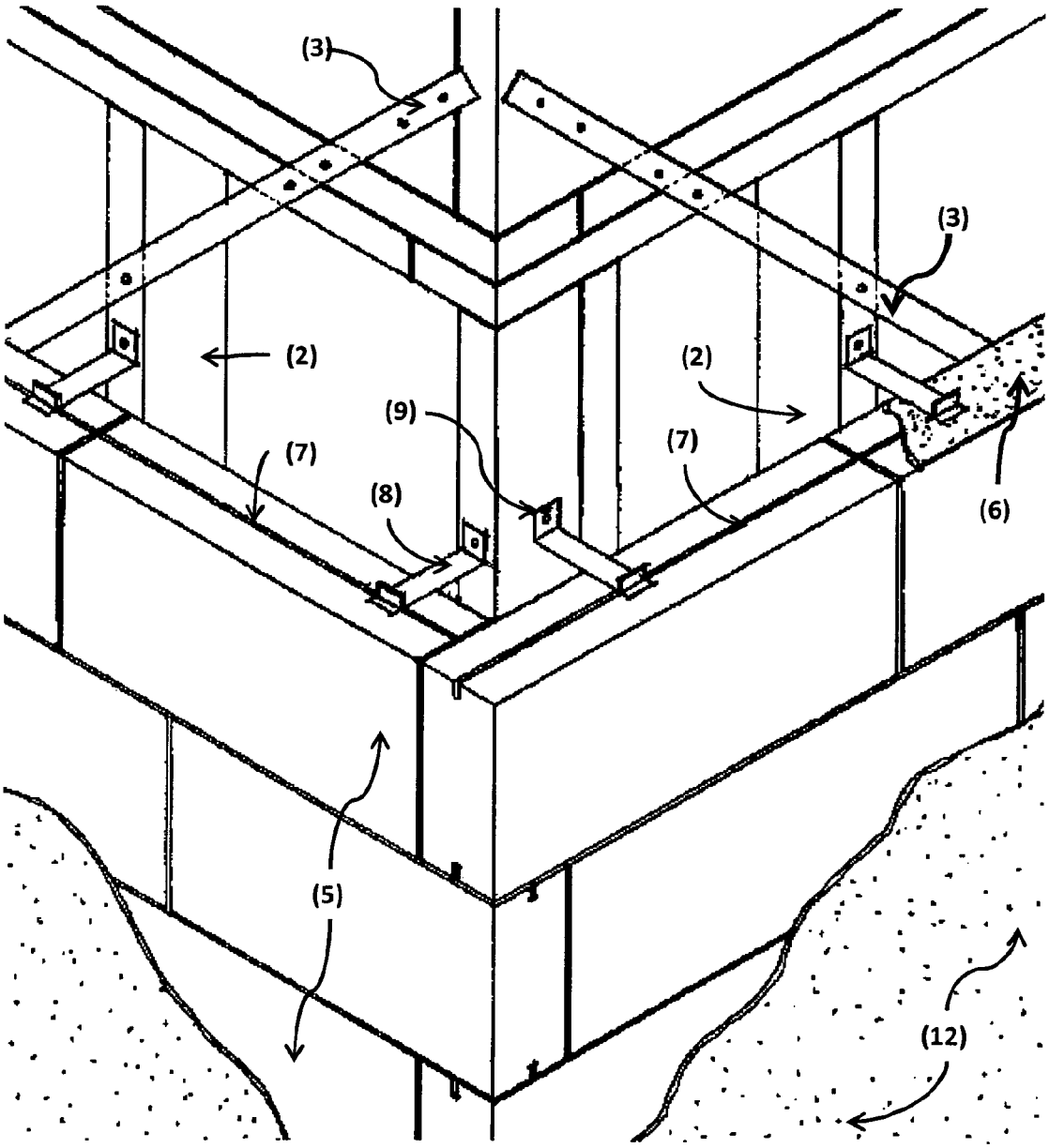
FIG. 1 illustrates an isometric view of a typical corner of the wall system assembly.
Figure 2:
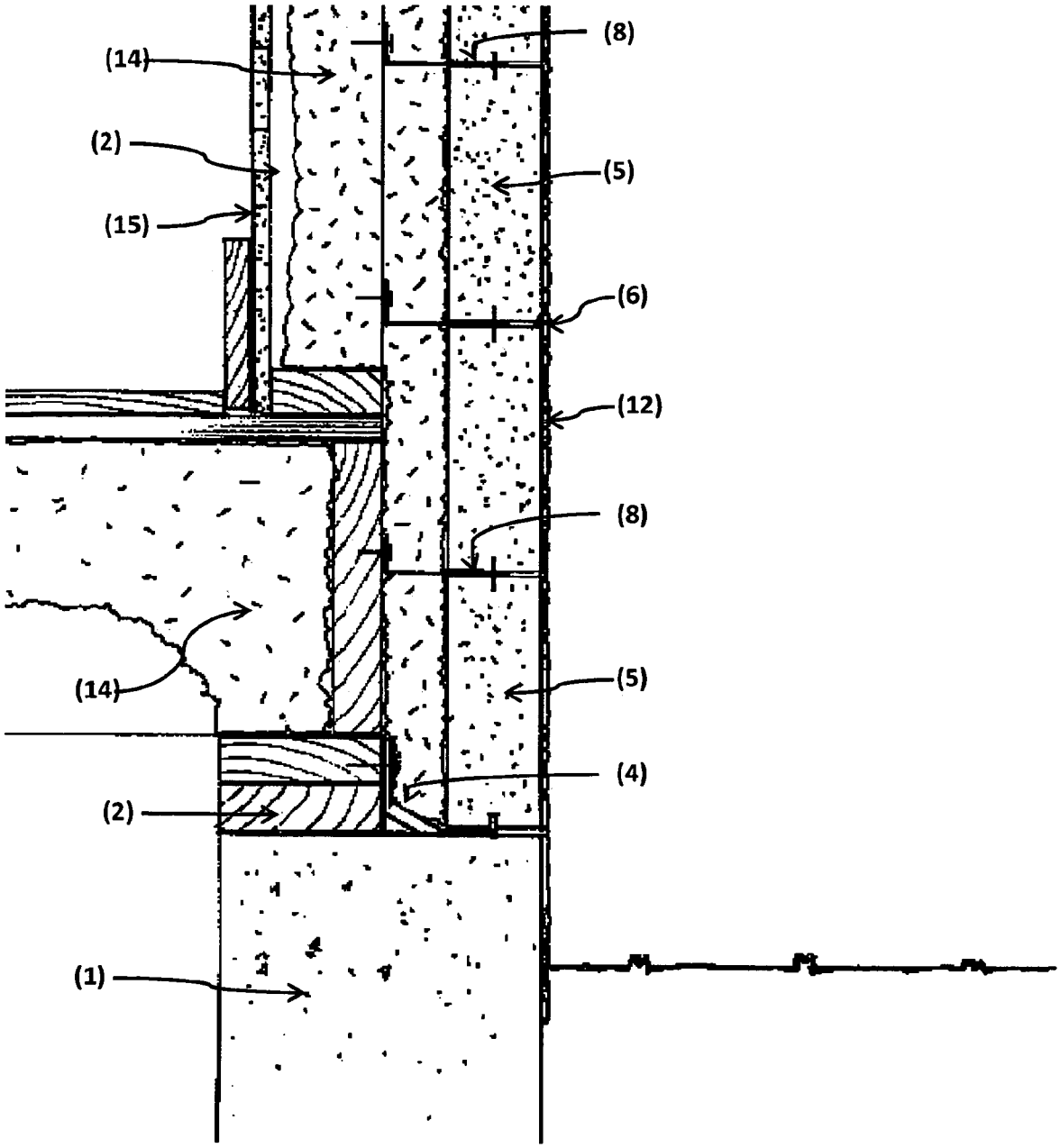
FIG. 2 illustrates a sectional view of the wall system assembly at the foundation.

FIGS. 1-5 illustrate an embodiment of the subject method of constructing a novel wall system. In this embodiment, a load-bearing frame 2 of wood and/or light-gage steel is erected with steel wind bracing 3 on a conventional concrete foundation 1. No sheathing is applied. FIG. 2 illustrates the grade of the building surface (not numbered) exterior to the concrete foundation 1. In one embodiment of the subject invention, the load bearing frame 2 may be anchored to the concrete foundation 1 through bolts (not shown) 3" to 10" inwards from the exterior edge of the concrete foundation 1.

The shelf angle 4 or starter piece is a continuous pultruded fiberglass shelf angle which is screwed to the load bearing frame at a level plane to create a level starter. Leveling grout may be added underneath the shelf angles 4 at any gaps between the shelf angles 4 and the foundation. The shelf angles 4 have a continuous interlock stub 4*a* which fits into a bottom groove of AAC blocks 5. The shelf angles 4 also comprise a vertical leg 4*b* that contains a traversing screw hole 4*c* for affixing the shelf angle 4 to the framing system using screws or bolts.

Shelf angle 4 is affixed continuously around the base of the load bearing frame 2 at a level plane on top of the concrete foundation 1. The interlock stubs 4*a* of the shelf angles 4 form a level starter track. A thin-bed mortar 6 with a thickness of 1/16" to 1/8" is placed over the starter track and AAC blocks 5 are laid on the level starter track. The AAC blocks 5 each have two grooves 7 on the top and the bottom which may be approximately 1/2" deep and 1/4" wide. As the AAC block 5 is laid down onto the starter track, the interlock stubs 4*a* of the shelf angles 4 are inserted into the bottom grooves 7 of AAC blocks 5.

In another embodiment of the subject invention, an adhesive may be added to the grooves 7 to provide additional attachment of the AAC blocks 5 to the shelf angles and the various clips disclosed in the subject invention.

In one embodiment of the subject invention, the AAC blocks are insect-proof, lightweight and insulating. In another embodiment of the subject invention, the AAC blocks 5 may have a thickness of 2" to 6", a height of 8" to 24" and a length of 24" to 48". In the preferred embodiment of the subject invention, the AAC blocks 5 comprise a thickness of 3".

Figure 6:
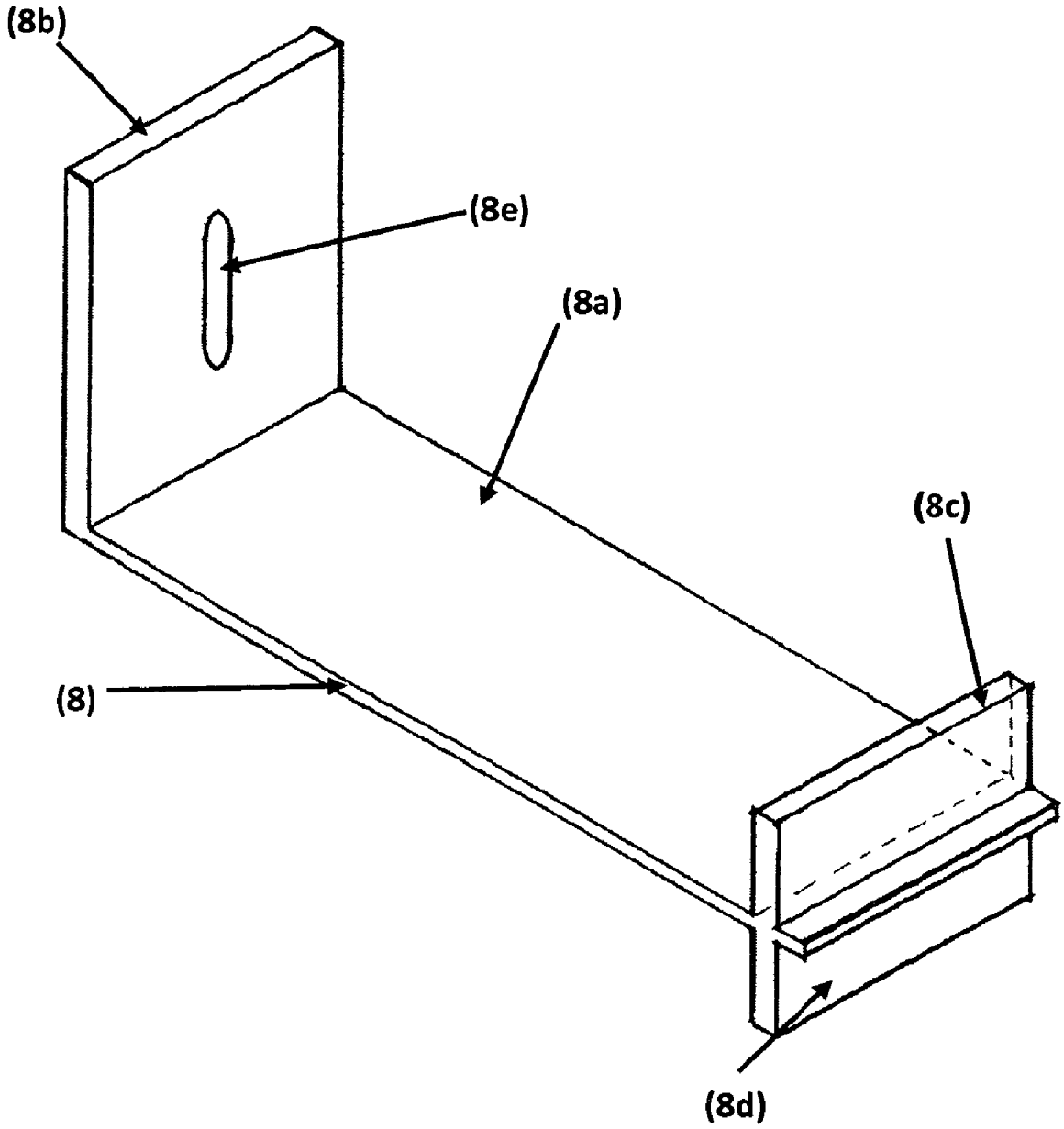
FIG. 6 illustrates a clip fastener of the wall system assembly.
Figure 7:
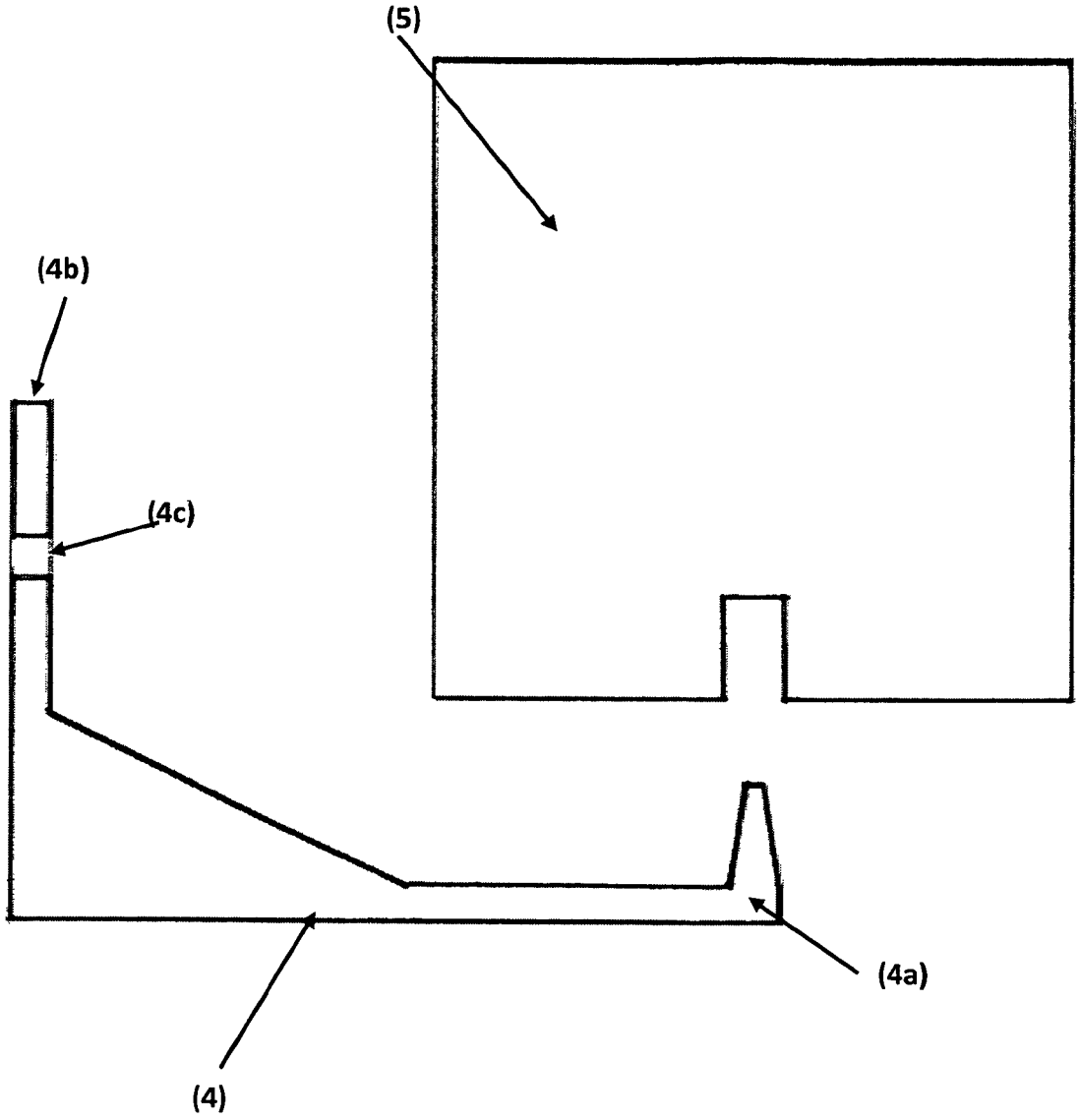
FIG. 7 illustrates a shelf angle starter piece of the wall system assembly.

After the initial set of AAC blocks 5 are placed over the interlock stubs of the shelf angles 4 through bottom grooves 7, clips fasteners 8 are inserted into the top grooves 7. Clip fasteners 8 may be comprised of plastic or metal. As illustrated in FIG. 6, clip fasteners 8 comprise a base surface 8*a* and three protrusions perpendicular to the base surface 8*a*: anchorage leg 8*b*, upward interlock stub 8*c* and downward interlock stub 8*d*. Clip fasteners 8 further comprise a hole 8*e* traversing the anchorage leg 8*b* for inserting a screw or bolt 9 for attaching the clip fasteners 8 to the wood or metal framing. The clip fasteners 8 may be screwed 9 to the framing studs setting the AAC blocks 5 away from the load bearing frame 2 by 1" to 3". Downward interlock stub 8*d* is inserted into the top grooves 7 of the AAC blocks 5 and the upward interlock stub 8*c* is inserted into the bottom groove 7 of the next layer of AAC blocks 5.

In this embodiment of the subject invention, layers of clip fasteners 8 and AAC blocks 5 are placed on top of one another and married to the framing. In the preferred embodiment of the subject invention, the offset between the load bearing frame 2 and the AAC blocks 5 is 2".

Once the AAC blocks 5 have been set, the windows 13, doors, electrical wiring and plumbing systems of the building structure may be installed.

In this subject invention, the vertical cavity between the framing and the wall of AAC blocks 5 is injected with foamed-in-place high-density closed-cell polyurethane foam 14. Because the urethane foam 14 is adhesive and structural, all components of the wall are bonded into a unified composite construction of great strength. In one embodiment of the subject invention, the polyurethane foam 14 may be waterproof, vapor-proof and non-toxic with high thermal resistance. In a further embodiment of the subject invention, the polyurethane foam 14 may have a water-vapor permeability of less than one perm and thermal performance of R-5 per inch. Conventional finishes such as plaster may be applied to the interior of the wall frame 15.

The exterior of the AAC blocks 5 may receive a cementitious stucco finish 12. In one embodiment of the subject invention, the stucco finish 12 may be impact-resistant, waterproof and decorative in a variety of colors.

Figure 3:
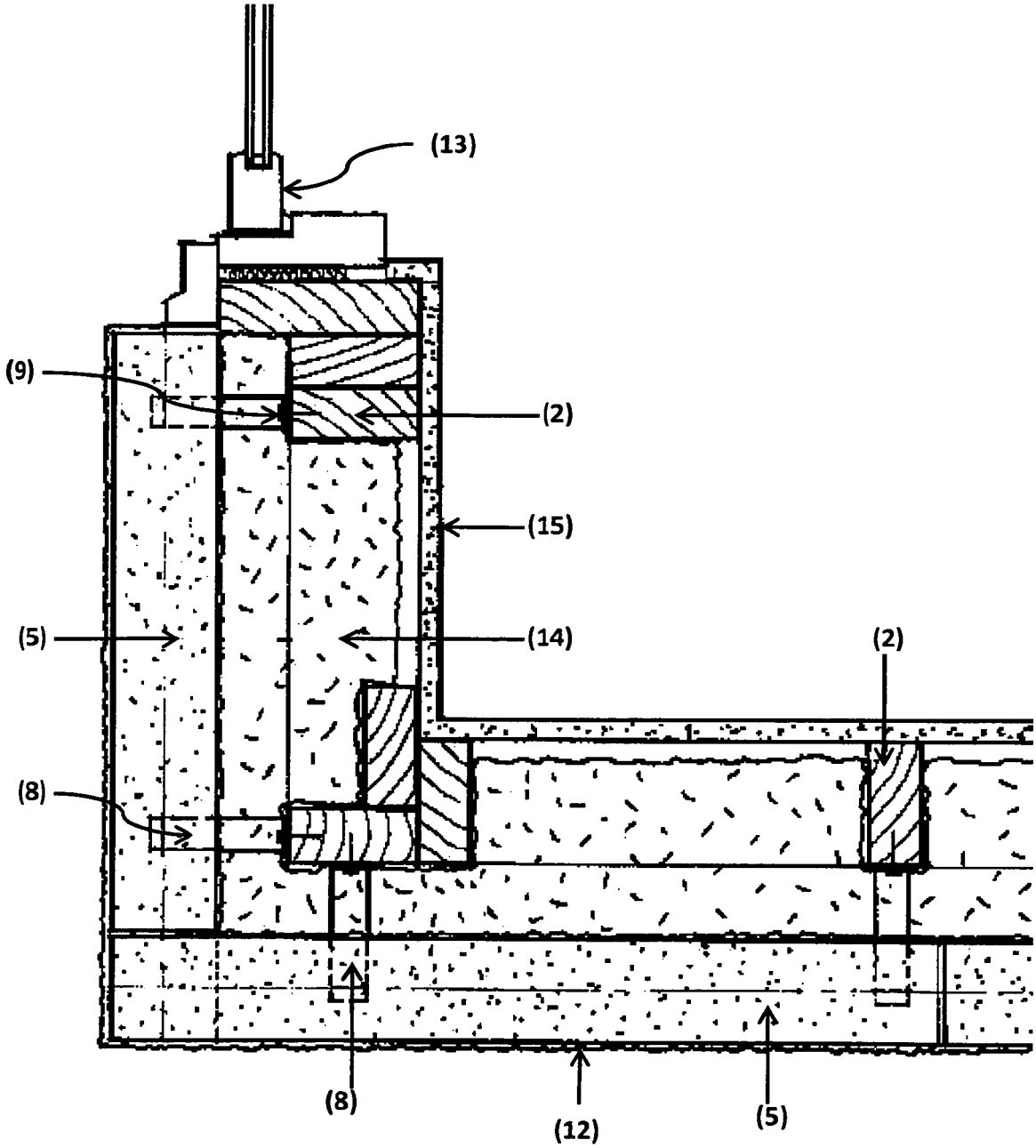
FIG. 3 illustrates a plan view of a corner wall and window jamb of the wall system assembly.

FIG. 3 illustrates a plan view of a corner wall and window jamb of the wall system assembly of the subject invention. In this embodiment of the subject invention, incorporation of a window 13 into the wall structure is shown.

Figure 4:
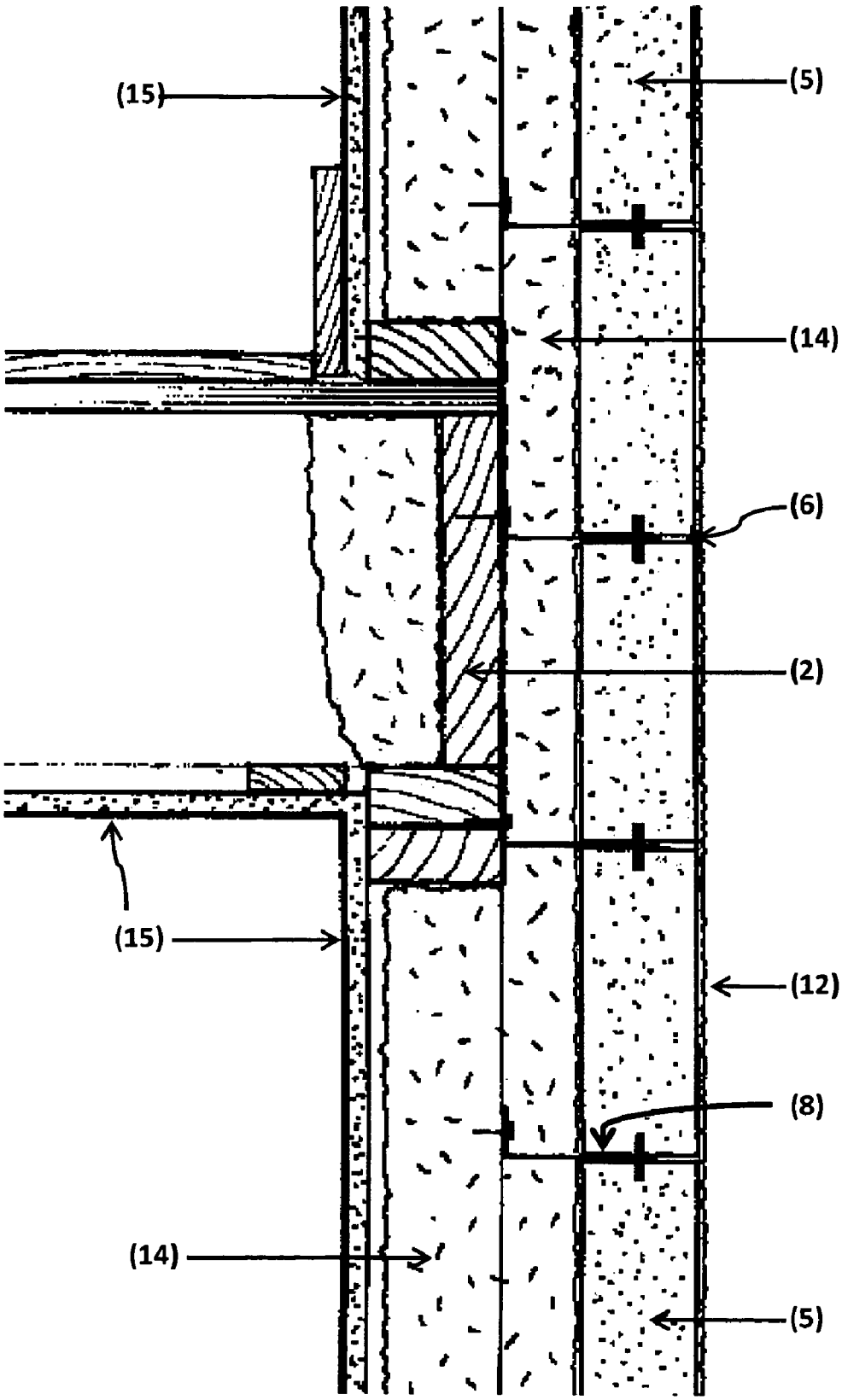
FIG. 4 illustrates a sectional view at an intermediate floor of the wall system assembly.

FIG. 4 illustrates one embodiment of a sectional view at an intermediate floor of the wall system assembly. In this embodiment, a frame joist may separate the floors in the structure as known to those skilled in the art.

Figure 5:
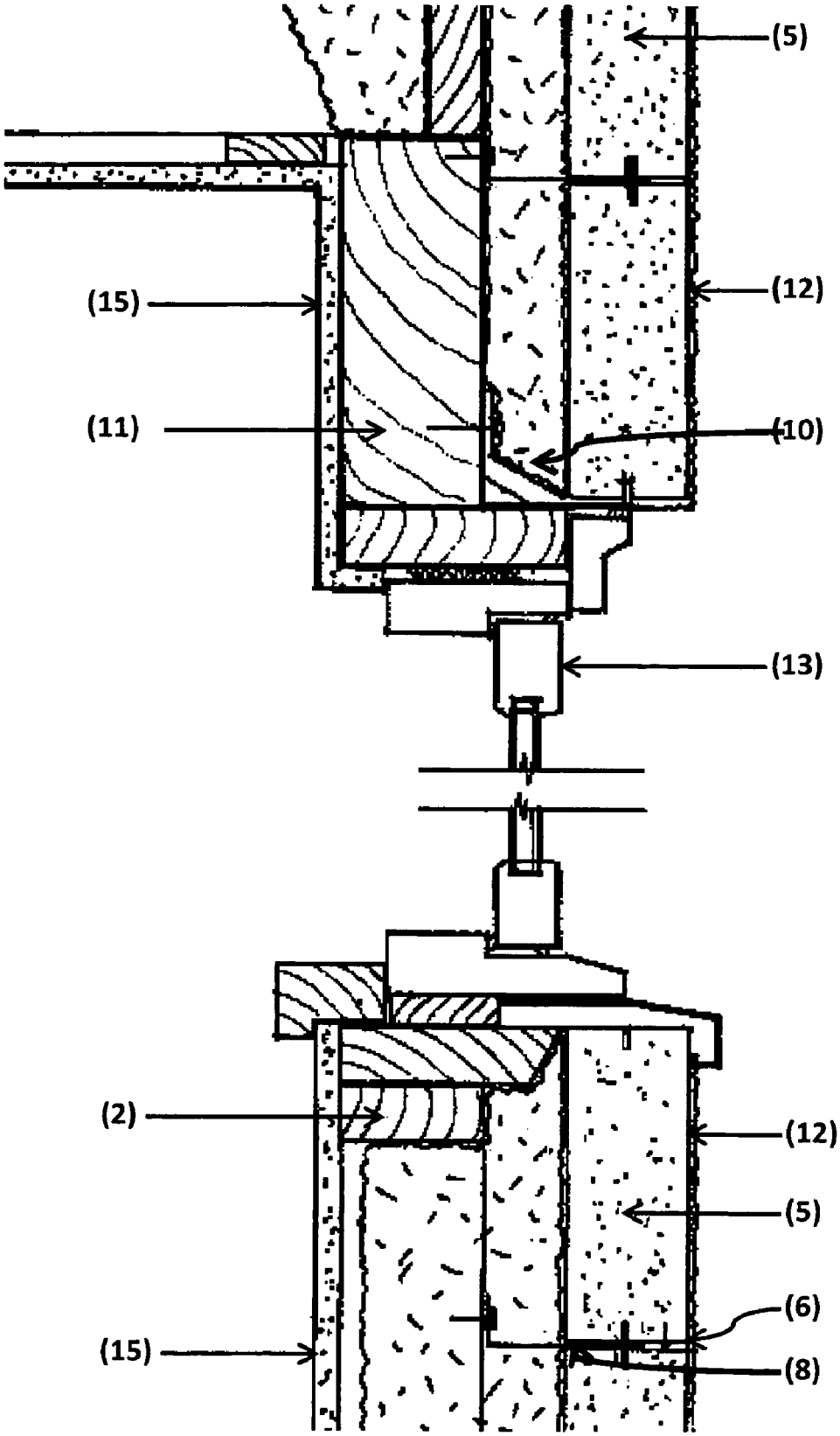
FIG. 5 illustrates a head and sill sectional view of the wall system assembly at a window.

FIG. 5 illustrates a head and sill sectional view of the wall system assembly at a window 13. In this embodiment of the subject invention, incorporation of a window 13 into the wall structure is shown. Lintels are created with a shelf angle 4 screwed to the lintel beam 11 of the load bearing frame 2.

In one embodiment, the clips of the subject invention may comprise lengths of 3" to 10". In another embodiment, the base surfaces of the clips of the subject invention may comprise heights of 1/8" to 4" and widths of 1/8" to 4". In a further embodiment, the extrusions of the clips of the subject invention clip may comprise heights of 1/8" to 4" and widths of 1/8" to 4".

In one embodiment of the subject invention, the resulting total wall thickness is approximately 8"-16".

What is claimed is:

1. A composite construction system comprising: a load bearing non-sheathed frame an AAC concrete construction unit, and an internal cavity of at least 1" width between the load-bearing frame and the AAC construction unit, wherein one side of the AAC concrete construction unit faces towards the load bearing non-sheathed frame, further wherein the load bearing non-sheathed frame is adhered to the AAC concrete construction unit using at least a single layer of urethane foam interposed between the load bearing non-sheathed frame and the AAC concrete completely filling the internal cavity, wherein the layer of urethane foam prevents thermal bridging between the load bearing non-sheathed frame and the AAC concrete; and a plurality of thermally non-conductive connection devices between the load bearing non-sheathed frame and the AAC concrete construction unit.

2. The composite construction system of claim 1, wherein the load bearing non-sheathed frame is made out of at least one of a group of materials consisting of solid wood, timber materials, engineered wood products, wood composite materials, steel and aluminum.

3. The composite construction system of claim 1, wherein each of the plurality of connection devices comprises at least a first attachment surface for attachment to the load bearing non-sheathed frame and at least a second attachment surface for attachment to the AAC concrete construction unit.

4. The composite construction system of claim 1, wherein the AAC concrete construction unit comprises a plurality of AAC blocks.

5. The composite construction system of claim 4, wherein each of the plurality of AAC blocks comprises at least one groove for attaching to the plurality of connection devices.

6. The composite construction system of claim 1, wherein the distance between the load bearing frame and the AAC concrete construction comprises 1" to 4".

7. The composite construction system of claim 1, wherein the connection devices comprise at least one traversing hole for accepting a screw, nail or bolt.

8. The composite construction system of claim 1, wherein the single layer of urethane foam comprises a width of 2" to 8".

9. A method of constructing a wall, the method comprising the steps of a) erecting a load-bearing frame defining front and rear faces of the wall on a foundation, wherein the load bearing frame has no sheathing;

b) placing a first plurality of thermally non-conductive connection devices on top of the foundation exterior to the load bearing frame, wherein each of the first plurality of connection devices comprises an interlock stub, further wherein each of the first plurality of connection devices is placed such that the interlock stub extends in an upward direction from the foundation distal from the load bearing frame;

c) placing a first plurality of AAC blocks on top of the placed first plurality of connection devices exterior to the load-bearing frame by inserting the interlock stubs of the placed first plurality of connection devices into a bottom groove on each AAC block, such that a vertical internal cavity is created between the load-bearing frame and the first plurality of AAC blocks, wherein the internal cavity has at least a 1" width between the load-bearing frame and the first plurality of AAC blocks, further wherein each AAC block further comprises a top groove;

d) placing a second plurality of thermally non-conductive connection devices on top of the first plurality of AAC blocks, wherein each of the second plurality of connection devices comprises a downward interlock stub and an upward interlock stub, further wherein each of the second plurality of connection devices is placed such that the downward interlock stub is inserted into the top groove of the first plurality of AAC blocks, and the upward interlock stub is distal from the load-bearing frame;

e) placing a second plurality of AAC blocks on top of the placed second plurality of connection devices such that the upward interlock stubs of the placed second plurality of connection devices are inserted into the bottom grooves of the second plurality of AAC blocks such that the first and second plurality of AAC blocks form the bottom exterior of the wall;

f) placing a third plurality of thermally non-conductive connection devices on the second plurality of AAC blocks using the method of step e;

g) repeating steps e and f using additional pluralities of AAC blocks and thermally non-conductive connection devices to form the exterior of the wall and expand the vertical internal cavity separating the AAC blocks and the load-bearing frame, wherein the expanded internal cavity comprises at least a 1" width between the load-bearing frame and the first plurality of AAC blocks;

h) applying an exterior finish to the exterior of the AAC blocks;

i) injecting a urethane foam into the vertical internal cavity and allowing said urethane foam to set and cure so as to adhere the load bearing frame to the AAC blocks, wherein the urethane foam seals the vertical internal cavity between the load bearing frame and the AAC blocks and prevents thermal bridging between the load bearing non-sheathed frame and the AAC concrete; and j) applying an interior finish to the interior of the load-bearing frame.

10. The method of constructing the wall of claim 9, wherein the urethane foam comprises polyurethane foam.

11. The method of constructing the wall of claim 9, wherein the polyurethane foam comprises a water-vapor permeability of less than one perm and thermal performance of R-5 per inch.

12. The method of constructing the wall of claim 9, the method further comprising the step of anchoring the first plurality of connection devices to the foundation.

* * * * *